US008371901B2

(12) United States Patent
Frey

(10) Patent No.: US 8,371,901 B2
(45) Date of Patent: Feb. 12, 2013

(54) PARTIAL FEMALE UNDERGARMENT FOR COVERING A WOMANS CHEST AND A METHOD FOR WEARING THE SAME

(76) Inventor: Betty Anne Frey, Indianapolis, IN (US)

( * ) Notice: Subject to any disclaimer, the term of this patent is extended or adjusted under 35 U.S.C. 154(b) by 396 days.

(21) Appl. No.: 12/771,048

(22) Filed: Apr. 30, 2010

(65) Prior Publication Data

US 2011/0265240 A1 Nov. 3, 2011

(51) Int. Cl.
*A41C 3/00* (2006.01)

(52) U.S. Cl. ..... 450/30; 450/33; 2/49.1

(58) Field of Classification Search ..... 450/86, 450/88, 1, 28, 30–33, 80; 2/102–106, 51, 2/54, 109, 113, 115, 144, 145, 1, 73, 78.1–78.4, 2/49.1–49.4
See application file for complete search history.

(56) References Cited

U.S. PATENT DOCUMENTS

| | | | | |
|---|---|---|---|---|
| 147,264 | A * | 2/1874 | Hodgkins | 450/57 |
| 626,589 | A * | 6/1899 | Buchner | 450/28 |
| 866,752 | A | 9/1907 | Way | |
| 905,270 | A | 12/1908 | Abraham | |
| 3,449,766 | A | 6/1969 | Garber et al. | |
| 4,495,660 | A | 1/1985 | Hayden | |
| 6,205,585 | B1 * | 3/2001 | Capparelli | 2/106 |
| 6,397,403 | B1 | 6/2002 | Waldman | |
| 6,935,921 | B1 * | 8/2005 | Eudenbach et al. | 450/54 |
| 7,409,728 | B2 * | 8/2008 | Harry | 2/106 |
| 2007/0032168 | A1 | 2/2007 | Macchi | |
| 2007/0281585 | A1 | 12/2007 | Calamari et al. | |

* cited by examiner

*Primary Examiner* — Gloria Hale
(74) *Attorney, Agent, or Firm* — C. John Brannon; Brannon Robinson PC

(57) ABSTRACT

A partial female undergarment slidingly attachable to a brassiere for covering a selected portion of a woman's chest or cleavage when an outer garment is worn over the brassiere. The partial undergarment includes a fabric panel that extends horizontally between the straps of the brassiere, and is removably attached to such straps while the outer garment is worn. The undergarment may be selectively positioned along such straps in the vertical position as desired by the woman, whereupon elastic means under tension removably retains the undergarment in the desired position. The lower portion of the undergarment may hang down to engage loose-fitting outerwear when the woman leans forward, such that the upper portion remains substantially adjacent the woman to cover her upper chest while the lower portion engages the outerwear to define an opaque screen obscuring her lower torso.

18 Claims, 5 Drawing Sheets

PARTIAL FEMALE UNDERGARMENT FOR COVERING A WOMANS CHEST AND A METHOD FOR WEARING THE SAME

CROSS-REFERENCE TO RELATED APPLICATIONS

This patent application claims priority to U.S. patent application Ser. No. 12/245,393 filed on Oct. 3, 2008 (now abandoned), which claimed priority to then U.S. Provisional Patent Application Ser. No. 60/978,063, filed on Oct. 5, 2007 (now abandoned).

TECHNICAL FIELD

The present invention relates to a partial undergarment intended for a woman to protect her modesty when wearing loose-fitting outer garments. More specifically, the present invention relates to a partial undergarment for covering part of a female's chest when an outer garment is worn over a brassiere, the partial undergarment including a panel of material specifically configured to extend between the two straps of the brassiere, and a button-and-loop fastener connected to the garment so the garment may be removably attached to the brassiere and can be easily adjusted vertically as desired by the woman. The garment preferably hangs above and between the cups of the brassiere, protecting the wearer from undesired or unintentional exposure of her chest area.

BACKGROUND

Women throughout decades and across cultures have struggled to manage their clothing to maintain a desired degree of modesty while pursuing an active professional and/or personal lifestyle. As teachers assist students, executives collaborate across a table, and medical professionals care for patients, carefully positioned outer garments often hang down away from the woman's chest, thereby exposing her cleavage and chest area to an undesired and/or unprofessional extent.

Likewise, a woman might desire to wear a certain outer garment during a later evening event after wearing that same garment during the day at her work. If the garment reveals too much, however, she might be forced to wear one outfit during the professional part of her day, then change into another outfit for evening or social events. Avoiding this inconvenience and the above-mentioned exposure is a long-felt need among women.

Still further, women who have chest scars from a mastectomy, heart surgery, or other procedures, struggle to reliably manage their clothing so that the scars are consistently covered. The present garment invention addresses these desires and needs.

DETAILED DESCRIPTION

Figures 1, 2:
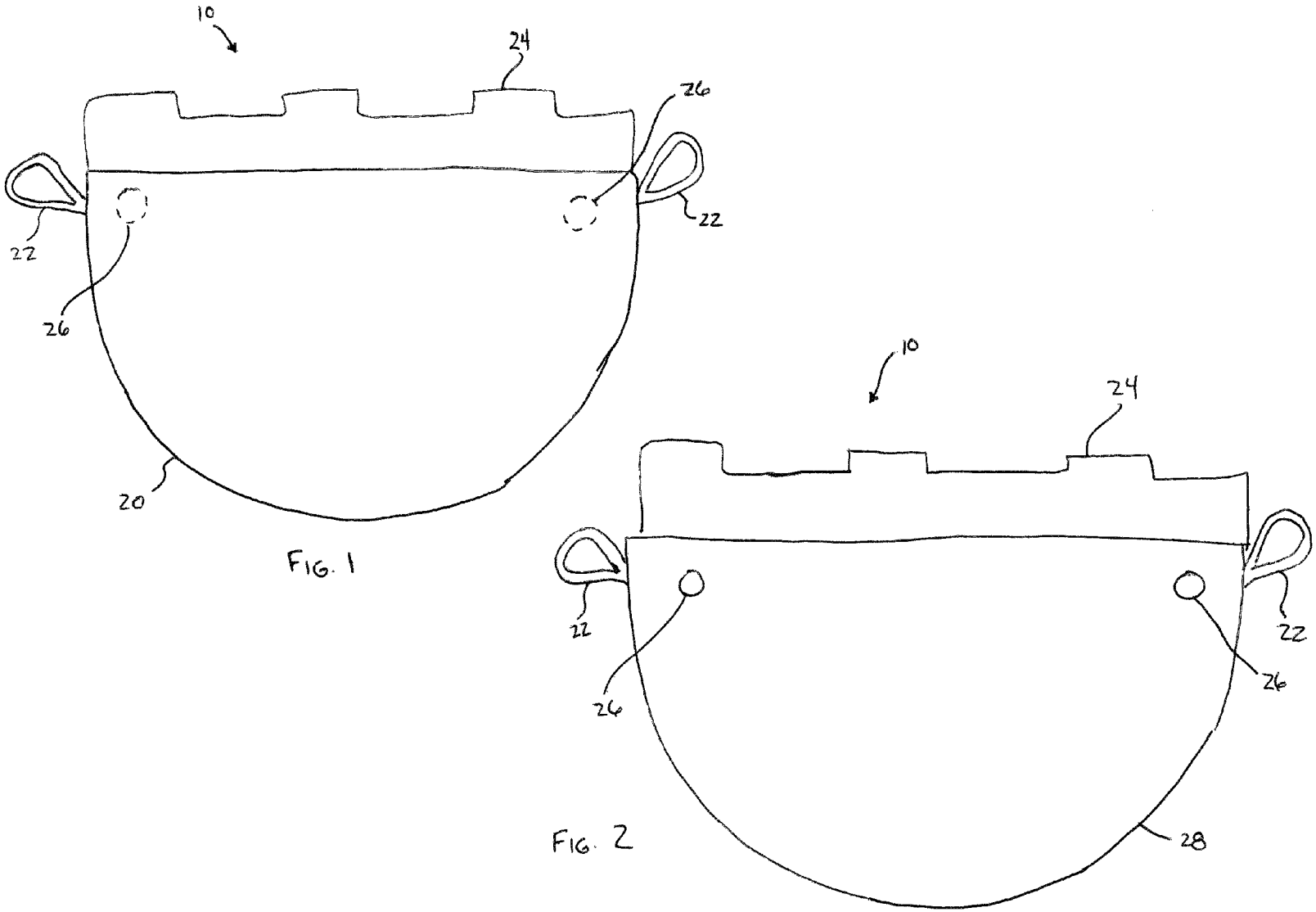
FIG. 1 is a front view of a garment according to a first embodiment.
FIG. 2 is a back view of a garment according to the first embodiment.

For the purpose of promoting an understanding of the principles of the present invention, reference will now be made to the embodiment illustrated in the drawings and specific language will be used to describe the same. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Generally, one form of the invention presents a chemisette-type garment that a woman may wear under a typically loose-fitting outer garment to control the unintended exposure of her chest and cleavage area. Such situations wherein loose-fitting outerwear may unintentionally and inappropriately fall away from a woman, such as when she leans forward, are common with caregivers, teachers, and business women, but may also occur in other situations. In one embodiment, the garment is moveably and removably attached to the straps of the brassiere above each cup, thereby laying across the woman's chest in a predetermined position, while being vertically adjustable by the user. Other embodiments will be described herein and will occur to those skilled in the art in view of this disclosure.

FIG. 1 illustrates a first embodiment of a garment 10 according to the present invention. The main body of the garment 10 comprises an elongated panel 20, which is sufficiently sized to span the width of a V-neck garment or the like at a suitable height on the body of the wearer, as will be discussed further herein. Attachment means 22 are also provided to secure the garment 10 to a brassiere, as will also be discussed below. Optional decorative trim 24 adds character or aesthetic features to the garment 10.

Referring now to FIGS. 1 and 2, a first embodiment fabric panel 20 is disclosed, having a perimeter edge 20', an upper portion 20A, which is generally rectangular in shape and having a generally straight edge 120A, and a lower portion 20B, which is generally semi-circular in shape and having a generally convex edge 120B. The panel 20 is typically opaque. Upper portion 20A has two opposing corners 21A, 21B and a substantially straight edge 21C extending therebetween. A pair of opposing attachment means 22 are affixed to the panel 20, with one such pair arranged proximal to each opposing corner 21A, 21B of upper portion 20A. Preferred attachment means 22 each comprise a band or loop 23 of elastic or other suitable material or fabric extending outwardly laterally from panel 20 proximal to upper ends 21A, 21B, and a button 26 arranged proximally to each opposing corner of upper portion 20B. Such means is specifically configured to slidably and movably attach the panel 20 between predetermined points on the respective shoulder straps of a brassiere. More particularly, the elastic attachment means 22 allows the wearer to slidably position panel 20 (upwardly or downwardly) to cover a selectable portion of the woman's chest area, while the tension created by loop 23 (indicated by reference arrows "a" in FIG. 3) secures the panel 20 in the vertical position as desired by the wearer. The lower portion 20B of garment 10 requires no attachment means. Garment 10 is not attached to the brassiere in any sort of fixed relation; rather the loops 23 of the garment 10 may be simply slid upwardly and downwardly along the brassiere straps, thereby enabling the wearer to slidably adjust the position of the garment 10 to the desired chest height. Once the garment 10 is positioned within the location desired by the wearer, the tension created by the elastic loop-and-button attachment means 22 secures the garment 10 in position.

FIG. 2 illustrates a back view of garment 10, by which the rear side 28 of panel 20 is shown, along with a rear view of elastic loops 23 and trim 24. In use, rear side 28 of garment 10 is typically worn against the body. Buttons 26 are secured (such as stitched, glued or the like) to the back side of panel 20 adjacent to each upper corner of panel 20. Each button 26 is typically spaced sufficiently apart from the edges of panel 20 (such as about ½ inch or so), such that they do not show when the garment 10 is worn. Further, buttons 26 are typically selected to have a low profile so as to not create bumps or protrusions visible from the front side when the garment 10 is in place. Shank buttons that are ½-inch in diameter with a flat, smooth-top surface are exemplary, as they minimize the likelihood of irritation of the wearer's skin.

Because all wearers vary in height, weight, breast size, body shape, and the like, this garment 10 is made commercially available in varying sizes, typically Small, Medium, Large and Extra-Large. Regardless of the size, however, the width of the panel 20 is typically about 1.2 to about 1.4 times greater than its height or length. This particular ratio of width-to-height ratio is typical because it is a sufficient width to extend across the wearer's chest to cover her chest area while still having the outward appearance of a complete undergarment. Research has shown that a garment too wide (that is, with a width-to-height ratio greater than about 1.4) tends to bunch at its side and fails to lay flat across the wearer's chest. The vertical length is thus sufficient to allow the wearer to slidably adjust the garment 10 upward or downward while still maintaining the appearance of a complete garment 10 by covering the wearer's cleavage area. For example, a woman having mastectomy scars, prostheses, psoriasis, or the like may desire to wear the garment higher up to conceal the scars and/or blemishes; for such wearers, mere modesty yields to practicality.

The embodiment illustrated in FIGS. 1 and 2 may be constructed as follows, although other suitable fabrication methods may be used. In this exemplary embodiment, these steps are primarily carried out using a sewing machine, while buttons 26 are typically sewn on by hand, in the sequential order set forth below. Alternative methods of construction will occur to those skilled in the art.

1. Cut two (2) lengths of elastic, typically about 4 to 6 inches in length and about ⅛ inch wide.
2. Cut a pattern of the shape shown in FIGS. 1 and 2, by using the appropriate specific dimensions for each size shown below. Prior to cutting, place the straight edge of the pattern along a fold in the fabric. When cutting, do not cut this fold in order to allow for an optimal appearance on the upper edge of the finished product as well as maximizing the overall aesthetics of the garment 10. As noted, the garment of this invention is made commercially available in four sizes: Small, Medium, Large and Extra-Large. The specific cut dimensions of the fabric panel 20 of the garment 10, by size, are:
   a. Small: 6 inches wide by 5 inches long
   b. Medium: 7.25 inches wide by 6 inches long
   c. Large: 8.5 inches wide by 6.5 inches long
   d. X-Large: 10 inches wide by 7 inches long
3. For styles with decorative or lace trim 24, cut lengths of lace according to the width of the straight edge for each size, such as:
   a. Small: 6 inches wide
   b. Medium: 7.25 inches wide
   c. Large: 8.5 inches wide
   d. X-Large: 10 inches wide
4. After cutting the fabric for panel 20, and keeping the fabric folded with the top side of the fabric to the inside, sew a straight line around the convexly curved edge of the garment 10 starting approximately 1.5 inches from the straight edge and approximately ⅛-inch from the edge, and ending approximately 0.75-inch from the other end of the straight-edge. It is preferable to then use a back-stitch at each end of the straight stitching to secure the stitch.
5. Using the larger of the two openings at the straight edge, turn the sewn fabric inside out and then insert a long object with a pointed end inside that same opening, such as a knitting needle or the like. Use the pointed end to fully extend the fabric and assure that the straight-edge of stitching around the curve of the panel is pushed out fully to maintain the appropriate shape. Then, press with an iron to secure the shape. Next, using a pair of scissors, trim the raw edges of the two openings to align those edges with the sewn curved edge and maintain the appropriate shape, in preparation for the next step.
6. For garments with lace or decorative trim 24, line up the lace 24 along the top, straight edge 21*c* of the garment panel 20. Using a straight stitch, sew the lace or decorative trim to the front of the garment. The stitch line will typically be no more than ⅛-inch from the top edge, preferably just 1/16-inch. This may vary depending on the style or width of lace or decorative trim 24 used.
7. Once lace or decorative trim 24 is attached to the panel 20, or for garments with no lace or decorative trim, the following steps are preferred:
   a. With the back 28 of the panel 20 facing up, fold one length of elastic band 22 in half and insert the raw edges ¼-inch into the opening on the right end of the straight edge, with the back 28 of the garment 10 facing up.
   b. Using a satin stitch at the start of the opening, along the curved edge, begin to sew around the curved edge. A back-stitch is then preferably used at the edge to secure the end of the thread and prevent it from pulling out.
   c. After securing the elastic band 22 in place, informational tags placed in line with the curved edge, and the satin stitching is continued until one nears the second opening.
   d. Allowing ¼-inch to insert the second piece of elastic, place the manufacturer's label along the curved edge and continue the satin stitching to the edge of that label.
   e. Then, fold the second length of elastic 22 in half and insert the raw edges ¼-inch into the second opening of panel 20.
   f. Continue satin stitching to the straight edge of the top edge 21*c* of the panel 20, in order to secure the elastic loop 23 in place. Again, a back-stitch is preferably placed at the edge to secure the end of the thread and to prevent it from pulling out.
   g. The satin stitching serves the purposes of securing the elastic loops 23 and tags, finishing the raw edges of the two openings in panel 20 and providing a more aesthetic appearance for the finished garment 10.

8. Press the garment a final time before completing the final step.
9. Secure one button 26 on each upper corner 21*a*, 21*b* to the back 28 of panel 20. Placement should be on top of the ¼-inch of elastic that was inserted and is hidden between the front panel of fabric 20 and back panel of fabric 28 of the garment 10. Then, thread a hand-sewing needle, line up the two ends of the thread, and knot together, trimming off any excess thread. Next, attach each button 26 by going through the shank sufficient times to assure that the button 26 is securely in place and will withstand moderate tension of the elastic loop 23 when attached to the strap of the wearer's brassiere. The thread typically only extends through the back panel 28 so it is not visible on the front of the garment 10. Preferably, taking the thread through the elastic at least once will strengthen the button attachment and render the garment more durable. The thread should not be pulled so tightly that the fabric puckers on either the front layer or back layer 28 of the panel 20.

Figure 3:
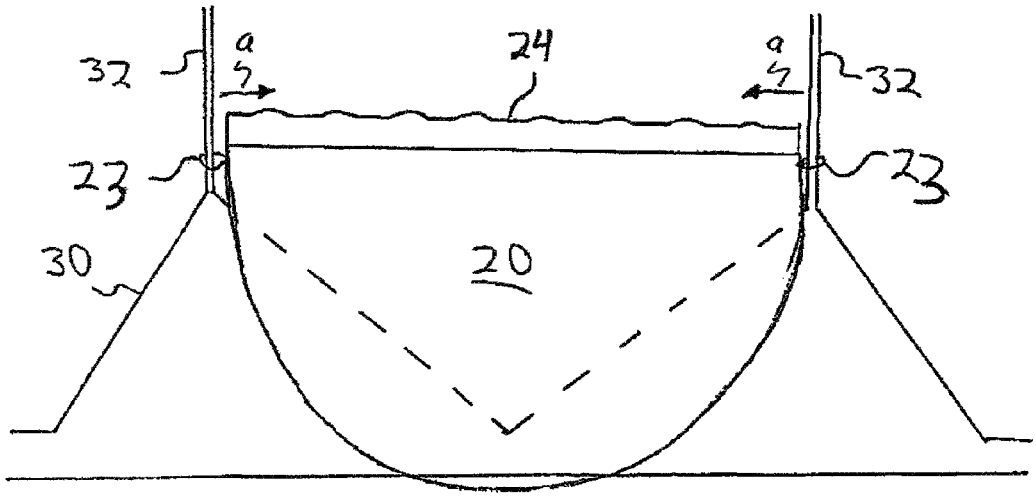
FIG. 3 is a front view of the garment according to the first embodiment in the first position relative to a brassiere.

FIG. 3 illustrates garment 10 attached to a user's brassiere 30 in a first position. To moveably and removably attach garment 10 to brassiere 30, one stretches each elastic loop 23 around the front, outside, and back of brassiere strap 32, then over button 26 carried on the rear garment layer or panel 28 (closest to the wearer's body). This attachment mechanism, especially when combined with the semi-circular shape of panel 20 in this embodiment, provides a movable attachment to brassiere straps 32 on each of the left and right side of the wearer while still providing the desired coverage. As noted above, the tension caused by elastic means 22 secures the garment 10 in the vertical position desired by the user.

Figure 4:
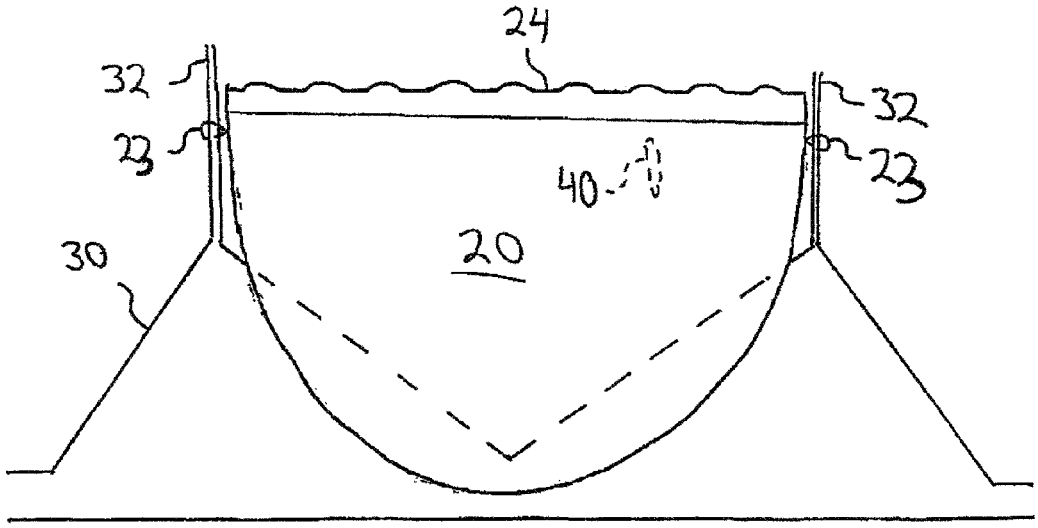
FIG. 4 is a front view of the garment according to the first embodiment in the second position relative to a brassiere.

FIG. 4 illustrates garment 10 in a second position relative to brassiere 30. As in FIG. 3, loops 23 have been placed around brassiere straps 32 and over buttons 26, thereby securing panel 20 in a second, higher fixed position relative to straps 32. In this second position, panel 20 can serve to conceal a scar 40 appearing on the wearer's chest.

Figure 5:
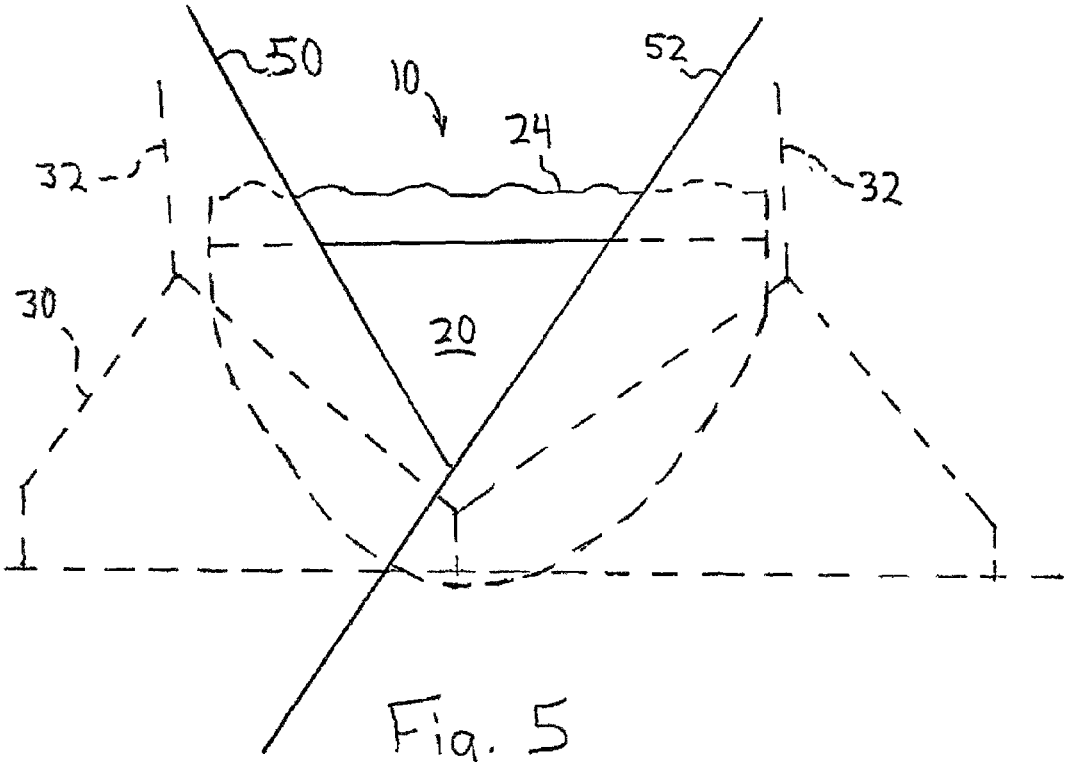
FIG. 5 is a front view of a garment according to the first embodiment in a first position attached to a brassiere and covered in part by an outer garment.

Turning now to FIG. 5, garment 10 is seen in place, attached to straps 32 of brassiere 30 underneath an outer garment including lapel panels 50 and 52. In this illustration, panels 50 and 52 depict a typical V-neck front of scrubs or other garment. Of course, use of this embodiment with alternative embodiments designed for use with other garments will occur to those skilled in the art based on this description. As shown in FIG. 5, the outward appearance of such an arrangement is that of a full blouse or top underlying the outer garment.

Figure 6:
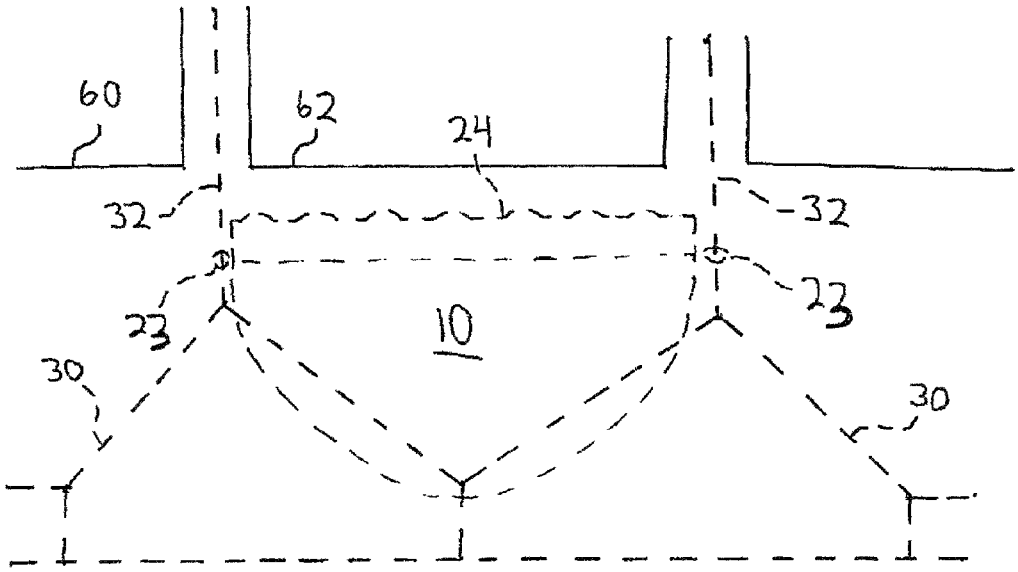
FIG. 6 is a front view of a garment according to the first embodiment in a second position attached to a brassiere and covered by an outer garment.

FIG. 6 illustrates garment 10 in a second position relative to brassiere 30 and straps 32, and worn with an outer garment 60 having a square-cut neck 62. This embodiment illustrates that garment 10 may be worn in a position that is entirely concealed from view while the wearer is standing upright. Garment 10 still functions in these circumstances to conceal scars, cleavage or other areas of the woman's chest when, for example, she bends over to assist a student or care for a patient in an educational, medical or other like setting. Because loops 23 maintain their tensioned position on straps 32, garment 10 stays close to the wearer's body even when outer garments hang more loosely.

Figure 7:
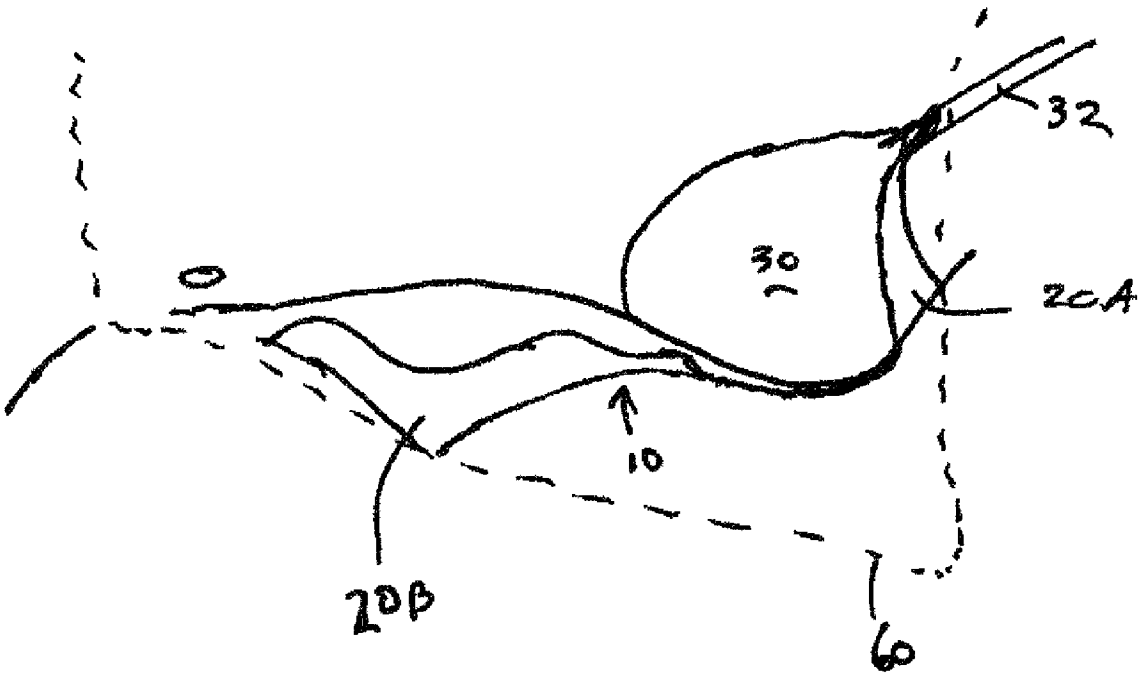
FIG. 7 is cutaway view of the garment according to the first embodiment in a third position attached to a brassiere, covered in part by and extending in part to an outer garment.

FIG. 7 illustrates garment 10 as worn under outerwear 60, such as medical scrubs or a loose-fitting blouse, when the wearer is bent forward. Outer garment 60 falls away from the wearer, and would potentially expose cleavage and/or the wearer's brassiere 30, as well as the wearer's lower torso. Upper portion 20A of garment 10 is connected to brassiere straps 32 while lower portion 20B is unconnected, and thus when wearer pivots forward, upper portion 20A stays in place while lower portion 20B pivots downward to contact the inner surface of the outerwear 60. Thus, garment 60 blocks not only cleavage and the brassiere 30 from view, but also the wearer's lower torso. This is particularly advantageous if wearer has navel jewelry, other body piercings, and/or has a tattoo or the like, and is desirous of concealing those things from colleagues and acquaintances in a professional environment. Likewise, wearer may have lower abdominal scars to hide, or may simply have a developed sense of modesty.

Figure 8:
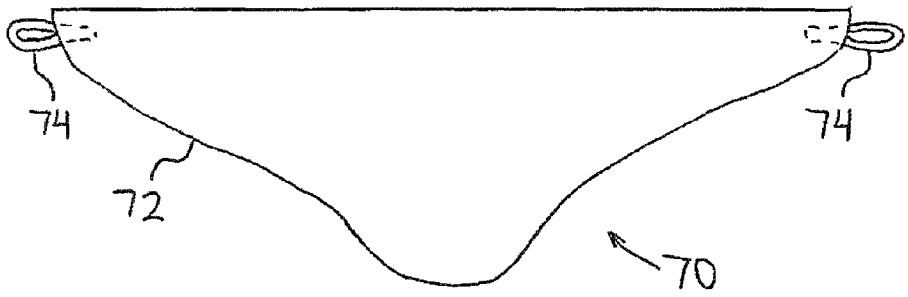
FIG. 8 is a front view of a garment according to a second embodiment.

FIG. 8 illustrates a second embodiment of the present invention. In this embodiment, garment 70 comprises a panel 72 that performs the concealing function, and loops 74 constructed of thin elastic cord, that secure garment 70 releasably and movably to straps 32 of a brassiere 30 (as shown in connection with loops 23 above) by being placed around the strap 32 and attached to a button or other structure (not shown) on the back side of garment 70. Note that this embodiment includes no decorative trim portion, and has a different panel shape than the first embodiment shown in FIGS. 1-6.

According to one embodiment of the instant invention, garment 10 is self-lined to provide a finished appearance. In this embodiment, many types of fabric content and color may be used, as well as many types, widths, and colors of lace and trim, to provide a wide variety of styles in order to appeal to the largest possible market. Likewise, as with the above-discussed embodiments, although shank buttons 26 are typically used to attach garment 10 to brassiere 30, various other types of buttons 26 could be used. In experimental use, low, flat, smooth, shank buttons, approximately ½-inch in diameter, have been found to work well, as they avoid poking into or irritating a woman's skin as she moves about.

While other attachment mechanisms might be used in a way that might removably and slidably attach a garment 10 at a particular vertical position along a brassiere strap 32, the button-and-loop elastic means 22 of the present invention as discussed and described herein has been selected as exemplary for several reasons. Various prior art devices include an undergarment being attached to the woman's body using body tape (for use without a brassiere, or with a strapless brassiere, for example), hook-and-loop strips (e.g., VELCRO®), hook-and-eye (with the hook being attached to a loop of fabric that is, in turn, attached to an eye sewn onto the reverse side of the garment), tie strings, fabric snaps (with one side of the snap sewn onto a loop of fabric and the other side of the snap sewn onto the reverse side of the garment), button and button hole, frog closures (where the raw ends of both pieces of the frog are sewn near the straight edge of garment), long loops on each end of the straight edge (that enable the woman to slip her arms through each loop), or safety pins that attach the garment to the brassiere straps or to the inside of outer garment. The loop-and-button attachment means 22 provided by the garment 10 is superior to these prior art alternative means. Tie strings often come untied and, if tied too tightly, often form a knot preventing the garment from being readily removed. Further, tied strings present the problem of a visible lump under the outerwear. With hook-and-loop attachments (VELCRO®), mating pads must be applied to the brassiere straps, necessitating the wearer to modify or alter her brassieres in order to employ such a garment; the inventive garment 10 requires no such modification of the user's current brassiere inventory. In addition, the attachment means 22 of the garment 10 is much more convenient and less irritating to the skin than self-adhesives, since self-adhesive attachment pads can generally be used only once, thereby requiring the user to constantly buy additional adhesives. Further, some people have moderate to severe allergic reactions to common adhesives. The elastic loop-and-button attachment 22 of the garment 10 is more comfortable to wear than hook-and-loop means or skin adhesives, and is much easier to put on and remove.

Various embodiments for garment 10 provide numerous clothing solutions for women. For example, they can be used to cover breast cleavage, when the torso outer garment does not cover as much of the breast cleavage as desired. Garment 10 is particularly convenient in providing more versatility with garments that show some cleavage. Such outerwear may be appropriate for most social situations, but not for professional situations such as the office, school or church. The garment 10 of the present invention allows a woman to have the coverage needed when wearing those types of outerwear to the office, while allowing easy removal of the garment when transitioning to an evening out, without the need to find a private place to remove an undergarment such as a camisole or tank top.

Similarly, garment 10 can provide coverage for female caregivers who wear scrubs to work. Scrubs are typically made with a V-neckline 50/52. When leaning forward too far to care for a patient, a typical torso garment falls away from the caregiver's chest, causing her to expose more of her chest than she might otherwise wish to expose. Here, the garment 10 lies flat against her chest, preventing this type of unwanted and distracting exposure. Additionally, garment 10 can provide additional coverage for female teachers. When leaning forward to assist a student, a typical torso garment falls away from the chest, causing the teacher to expose more of her chest than she might otherwise wish to expose. In this situation, too, the garment 10 lies flat against the chest, preventing this type of unwanted and distracting exposure. Further, garment 10 may provide coverage for professionals and businesswomen when leaning forward, such as across a conference table or desk, preventing undesired and distracting exposure of cleavage and/or torso.

Further, in these situations wherein the wearer leans forward, the lower portion 20B falls down and forward to rest against the inner surface of the outer torso garment, defining an opaque screen that further obscure the lower portion of the wearer's torso. In addition to the situational appropriateness described above, the wearer may suffer from skin disorders, such as psoriasis, and desire greater portions of her torso to be obscured from view. Alternately, the wearer may favor navel jewelry and/or have skin décor, such as a tattoo, on her stomach and desire to obscure these from sight in professional situations.

As noted above, garment 10 can also provide desired coverage of scars (see FIG. 4) for women who have had breast, heart, or other surgeries in the chest area, without the need for buying only upper-body garments with high neck lines. Likewise. garment 10 may provide coverage of tattoos, piercings and the like, both on the upper and lower torso, that may be inappropriate to display at the office, church, in front of the grandchildren, or like situations.

Further, garment 10 provides an easy solution for nursing mothers who are unable to wear camisoles and tank tops as undergarments. Standard camisoles and tank tops prevent the needed accessibility to the breasts for nursing. Garment 10 provides the function of a standard camisole or tank top undergarment, with the ease of access to the breast similar to that provided by a nursing brassiere and/or nursing camisole, while providing more comfort with less expense.

Finally, garment 10 can be used to provide a fashionable layered look, without the discomfort and inconvenience of wearing two full garments about one's torso. Discomfort and inconvenience commonly mentioned by customers include bulkiness, feeling padded, twisting, and bunching of the undergarment, and causing undesired warmth in warmer seasons. Likewise, an inventory of the inventive garments 10 provides variety at less expense than an inventory of standard camisoles or the like. Garment 10 solves all of these long-felt needs.

All publications, prior applications, and other documents cited herein are hereby incorporated by reference in their entirety as if each had been individually incorporated by reference and fully set forth. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A garment accessory for attachment to a brassiere worn under outerwear, consisting of:

an elongated panel of fabric having a perimeter edge, an upper portion and a lower portion, the upper portion having two opposing corners; and two attachment features, each attachment feature comprising a button and a loop of elastic removably securable to said button, one of said attachment features being affixed to the panel proximally to each opposing corner of the upper portion;

wherein the attachment features are configured to slidably attach the panel between predetermined points selected by the wearer on respective shoulder straps of the brassiere;

wherein the lower portion of the garment accessory is free to move away from the wearer; wherein when the attachment features slidably attach the panel to the respective shoulder straps of the brassiere, said panel covers a selectable portion of the chest of the wearer and is secured in position by the tension between the elastic loops and the brassiere straps; and wherein when the wearer leans forward, the outerwear hangs away from the chest of the wearer and the upper portion covers the chest of the wearer and the lower portion pivots away from the wearer to engage the outerwear to define an opaque screen blocking the lower torso of the wearer from view.

2. The garment of claim 1, wherein the perimeter edge of the fabric panel comprises:

a substantially straight edge portion extending along the upper portion of the garment between the opposing upper corners; and a convex curve portion extending along the lower portion of the garment, the curve portion terminating at the respective opposing ends of the substantially straight upper edge.

3. The garment of claim 2, wherein the convex curve does not include an attachment feature.

4. The garment of claim 1, wherein when the attachment features slidably attach the panel to the respective shoulder straps of the brassiere and when the woman is positioned upright, the substantially straight edge is positioned substantially horizontally across the woman's chest.

5. The garment of claim 1, wherein each of the attachment features defines means for slidably and removably attaching the fabric panel between predetermined vertical points along the respective shoulder straps of the brassiere.

6. The garment of claim 1, wherein the panel of fabric comprises a single layer of fabric folded over to define a dual-layered panel, wherein one layer is outwardly facing and the second layer is inwardly facing and is disposed adjacent the body of the user when the garment is worn.

7. The garment of claim 6, wherein each of the attachment buttons are secured only to the inward-facing layer of the dual-layered panel, so as to render the button attachment unobservable from the front side of the user.

8. The garment of claim 1, wherein the garment has a width that is about 1.2 to about 1.4 times greater than its length.

9. A method of covering an uncovered portion of a woman's chest, comprising:

providing a brassiere having first and second shoulder straps;

providing an article of outerwear defining a central uncovered cleavage area;

providing a garment accessory that consists of:

an elongated and substantially opaque fabric panel having an upper portion having a first upper corner and a second upper corner, a lower portion, and a substantially straight edge between the first upper corner and a second upper corner;

two attachment buttons, each respective button attached to the panel proximally to a respective corner at an end of the substantially straight edge; and two loops of elastic, each respective loop of elastic extending from the panel and positioned proximally to a respective button, wherein each respective loop of elastic may be extended around a brassiere strap and engaged with a respective button to attach the garment to the brassiere strap;

removably and slidably attaching the first corner of the garment accessory to the first shoulder strap of a brassiere being worn by a woman;

removably and slidably attaching the second corner of the garment accessory to the second shoulder strap of the brassiere; and wearing the outerwear over the brassiere and lower portion of the garment accessory;

wherein attaching the garment accessory to the respective brassiere straps covers the uncovered cleavage area; and wherein when the woman leans forward, the lower portion of the garment accessory is free to move forward to contact the outerwear to define an opaque screen for blocking a lower portion of the torso of the woman from view.

10. The method of claim 9, wherein the panel has a perimeter edge consisting of:

the substantially straight edge extending between the first and second corners; and a convex curve having ends that meet the respective ends of the substantially straight edge.

11. The method of claim 9, wherein the garment accessory is not attached to said outerwear.

12. The method of claim 9 wherein, when the attachment features attach the panel to the respective shoulder straps such that when the woman is positioned upright, the substantially straight edge is positioned substantially horizontally across the chest area of the woman.

13. The method of claim 9, wherein the garment has a width that is about 1.2 to about 1.4 times greater than its length.

14. A garment accessory for attachment to a brassiere having shoulder straps, consisting essentially of:

an elongated panel having an upper portion and a lower portion and made of a single piece of fabric folded over to form a dual-layered panel comprising an outer layer and an inner layer, the panel having two opposing corners and a substantially linear edge extending therebetween;

a pair of attachment features, one being affixed to the upper portion proximally to each corner; and a strip made of a second fabric, different from the elongated panel, the second strip being attached to the first panel along the linear edge;

wherein the attachment features are configured to moveably attach the garment accessory between predetermined vertical points selected by the wearer on respective shoulder straps of a brassiere being worn by a woman;

wherein the second fabric is more resilient than the first fabric to stretching along the dimension parallel to the straight edge;

wherein when the attachment features attach the upper portion to the respective shoulder straps, the upper portion covers a selectable portion of the chest of the woman and the lower portion is free to engage an article of outerwear worn by the woman to obscure the lower torso of the woman from view.

15. The garment of claim 14 wherein the panel edge consists of:

the substantially linear edge; and a convex portion having ends that meet the ends of the substantially linear edge.

16. The garment of claim 15, wherein the convex portion lacks an attachment feature.

17. The garment of claim 14, wherein each of the pair of attachment features comprise an elastic loop and a button, the loop being secured to the edge of the elongated panel proximal to the button.

18. The garment of claim 17, whereupon when the garment is selectively positioned by the user vertically along the brassiere straps, the elastic loops are each stretched about their respective shoulder strap and are releasably secured around their respective button, wherein each loop is under elastic tension sufficient to secure the garment accessory in the vertical position desired on each respective shoulder strap so that said linear edge extends horizontally across the wearer's chest and wherein each attachment button is secured to the inner layer of the first fabric panel and not to the outer layer of the first fabric panel.

* * * * *